United States Patent [19]

Ross, Jr.

[11] Patent Number: 4,662,006

[45] Date of Patent: May 5, 1987

[54] MULTI-PLY GLOVE OR MITT CONSTRUCTION

[75] Inventor: Charles Ross, Jr., Gloversville, N.Y.

[73] Assignee: Grandoe Corporation, Gloversville, N.Y.

[21] Appl. No.: 772,381

[22] Filed: Sep. 5, 1985

[51] Int. Cl.[4] ..... A41D 19/00

[52] U.S. Cl. ..... 2/158; 2/164; 2/167

[58] Field of Search ..... 2/158, 159, 161 R, 161 A, 2/164, 167, D5, D6, 168, 169

[56] References Cited

U.S. PATENT DOCUMENTS

| | | | |
|---|---|---|---|
| 374,676 | 12/1887 | Helfaer | 2/164 X |
| 2,072,541 | 3/1937 | Burnham | 2/164 |
| 2,304,137 | 12/1942 | Peakes | 2/164 X |
| 2,735,108 | 2/1956 | Cremer | 2/158 |
| 3,114,915 | 12/1963 | Gross | 2/158 |
| 4,355,424 | 10/1982 | McCoy, Jr. | 2/164 X |
| 4,395,455 | 7/1983 | Frankosky | 2/272 X |
| 4,430,759 | 2/1984 | Jackrel | 2/159 |

FOREIGN PATENT DOCUMENTS

| | | | |
|---|---|---|---|
| 6503302 | 5/1966 | Netherlands | 2/158 |
| 8191 | of 1892 | United Kingdom | 2/164 |
| 904804 | 8/1962 | United Kingdom | 2/158 |

*Primary Examiner*—Henry S. Jaudon
*Assistant Examiner*—T. Graveline
*Attorney, Agent, or Firm*—Robert W. Fiddler

[57] ABSTRACT

A multi-ply glove or mitt construction having a multi-ply shell and multi-ply selectively removable liner is provided with interengaging contacting surfaces. The shell is formed by an outer water repellant layer and an inner heat insulating layer, between which is sandwiched a relatively waterproof breathable layer. A slide layer is formed on the inner surface of the inner heat insulating layer. The insulating layer of the shell is preferrably formed of a lofting material such as down, DACRON or THINSULATE fiber, or the like natural or synthetic fibrous materials lending themselves to lofting. The slide layer faces the interior of the glove and is formed of a material providing a shiny surface by means of a non-brushed knit or woven synthetic such as nylon and/or similar sheet synthetic. The interior removable liner is formed of relatively porous moisture absorbent material such as a pile fabric, or woven, knitted, or felted fabric of natural or synthetic fiber, or encased lofting material having a preferrably coarse outer surface layer, and relatively smooth inner surface layer. The interior of the shell and the exterior of the liner are provided preferrably adjacent their cuffs with interengaging means, preferrably in the form of VELCRO.

20 Claims, 4 Drawing Figures

MULTI-PLY GLOVE OR MITT CONSTRUCTION

BACKGROUND OF INVENTION

This invention relates to the art of multi-ply glove or mitt constructions having an outer shell providing a desired heat insulating and waterproof enclosure for the hands of a wearer, and permitting selective increase of the degree of insulation by providing a selectively removable and/or exchangeable liner in the shell, and further permitting any necessary drying of the liner due to perspiration accumulations or inadvertant wetting which can not normally be eliminated through the waterproof enclosure.

A variety of multi-ply glove or mitt constructions have in the past been evolved, and such multi-ply constructions have been formed in the past with removable liners selectively positionable within a shell.

However, in utilizing the previously evolved multi-ply glove or mitt constructions, problems are often found to arise in positioning and maintaining the liner in desired position within the shell of the glove or mitt, and in comfortably removing and/or repositioning the hand with respect to the glove or mitt without displacing the liner.

SUMMARY OF THE INVENTION

It is with the above considerations in mind, that the present improved multi-ply glove or mitt construction has been evolved providing desired protection of the hands from cold and/or wet conditions, while at the same time permitting selective control over the warmth and dryness of the glove.

It is accordingly among the primary objects of this invention to provide an improved mitt or glove construction serving to provide desired warmth and dryness to the hands of the wearer.

A further object of the invention is to provide an improved mitt or glove construction permitting the user to selectively control the temperature provided by the mitt or glove.

Another object of the invention is to provide an improved means for selectively positioning a pre-selected mitt or glove liner in an outer shell.

It is also an object of the invention to provide means facilitating the insertion or removal of the hand into and from a removable liner of a mitt or glove without displacing the liner.

A further object of the invention is to provide an improved multi-ply glove or mitt construction with a shell and removable liner, each of which may be independently employed to obtain desired degrees of hand protection.

These and other objects of the invention which will become hereafter apparent are achieved by forming a multi-ply shell and a selectively removable liner. The shell is formed with an outer water repellant layer of leather, closely woven textile fabrics, or the like. An inner heat insulating layer is preferrably formed of a lofting material such as down, DACRON, FIBERFILL, THINSULATE fiber, or foam. A waterproof breathable layer formed preferrably of a poromeric material such as GORE-TEX is arranged between the water repellant layer and the heat insulating layer, and a slide layer formed of a relatively smooth material such as brushed nylon or the like is formed on the interior surface of the heat insulating layer, and may be bonded thereto. The inner slide layer on the insulating layer is preferrably formed with a brushed surface permitting relatively free movement of another material thereover, yet acting to retain a material in positon, so that the liner may readily be inserted, but tends to remain in position after insertion.

A liner is provided for selective positioning within the shell. The liner is preferrably of a multi-ply construction formed to provide different degrees of heat insulation dependent on climatic conditions. The liner may be formed of a pile synthetic natural, or blend fabric, or of a lofting material, or a knitted cashmere or the like. The exterior face of the liner is formed with a coarse surface layer provided by applying a brushed or sueded material such as woven or knit nylon or the like, and the interior surface of the liner is preferrably provided with a slide layer formed by utilizing a non-brushed nylon to facilitate insertion of the hands of the wearer.

Arranged at the cuff of the liner and the cuff of the shell are mating fastening elements, provided by mating VELCRO strips, zippers, and the like serving to permit selective attachment of the liner to the shell.

A feature of the invention resides in the utilization of slide surfaces and coarse surfaces between the shell and the liner to facilitate insertion of the liner in the shell while at the same time serving to maintain the liner in desired position within the shell.

Another feature of the invention resides in the positioning of VELCRO or other fastening means between the outer cuff of the liner and the inner cuff of the shell so that the fastening means are relatively hidden and subject to ready bypass by the body of the liner as it is inserted into the shell.

BRIEF DESCRIPTION OF THE DRAWINGS

The specific details of the invention enabling those skilled in the art to make and use the invention will be provided in full, clear, concise and exact terms in conjunction with the accompanying drawings wherein.

DETAILED DESCRIPTION

Referring more particularly to the drawings, like numerals in the various figures will be employed to designate like parts.

Figure 1:
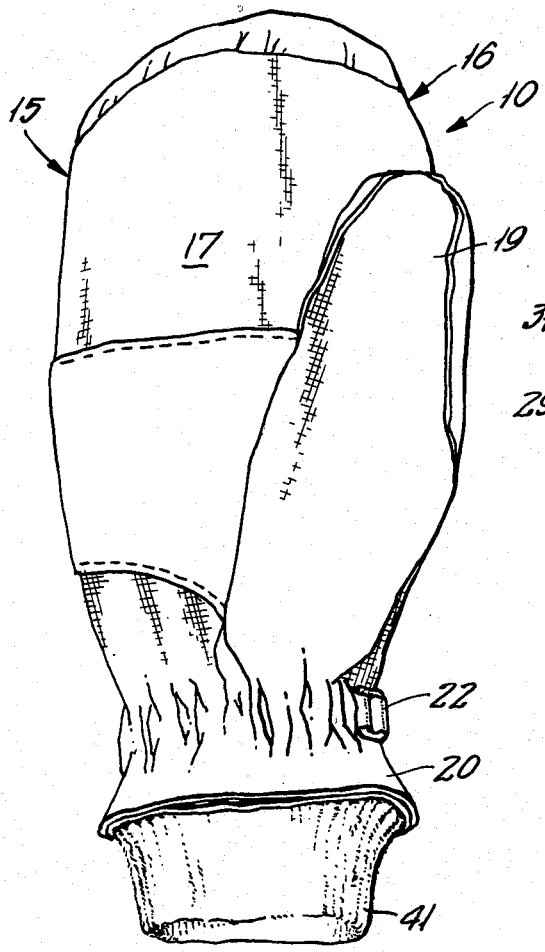
FIG. 1 is a perspective schematic view of a mitt made in accordance with the teaching of the invention, showing a wrist engaging "wristlet" of a liner extending beyond the cuff of the shell of the mitt.
Figure 2:
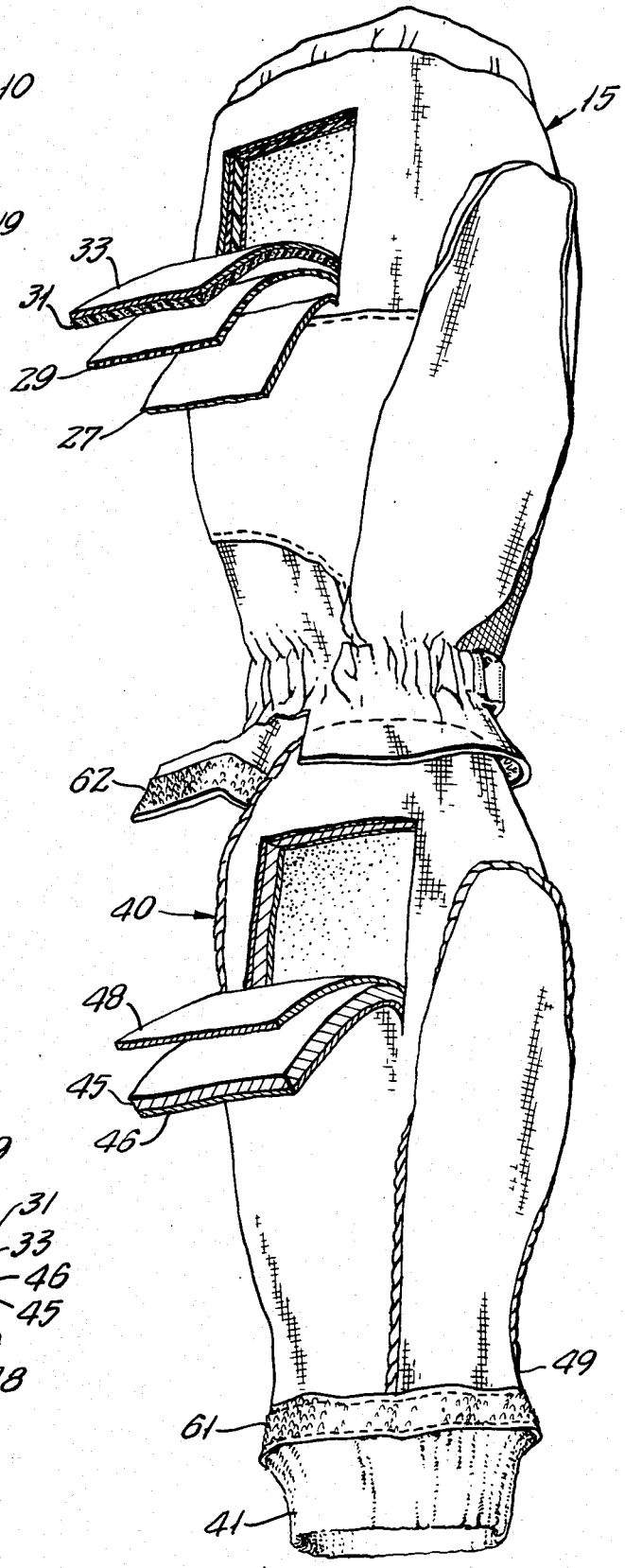
FIG. 2 is an exploded perspective view with the liner (at the bottom) separated from the shell flaps cut and folded out from the shell and liner of the mitt as shown in FIG. 1.

The improved mitt construction illustratively shown in FIGS. 1 and 2 as embodying the invention relates to a mitt of a type such as employed by skiers. The illustratively shown mitt 10 is formed with an outer shell 15, which is formed conventionally with a hand enveloping portion 16 having a palm 17 and a thumb enveloping portion 19. A cuff 20 is formed as conventionally at the open end of the mitt shell 15 which in the illustrated embodiment is provided with a strap 22 to permit selective tightening of the cuff about the wrist of the wearer.

Figure 3:
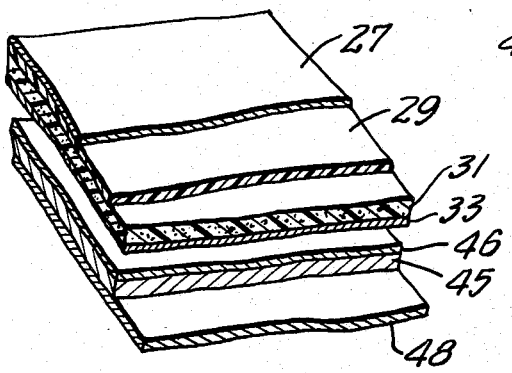
FIG. 3 is a perspective cut-away segment showing the layers of the shell and liner of the mitt shown in FIG. 1.

The shell 15, as best seen in FIG. 2 is of a multi-ply construction, as shown by the cut and folded out flap in the upper portion of FIG. 2, and the upper portion of FIG. 3. This multi-ply construction comprises an outer water repellant layer 27 which may be formed of a variety of conventionally employed glove shell materials, such as leather, closely woven textile fabrics commonly referred to "canvas" and may be formed of nylon or other synthetic, natural, or blends of fibers, or the like, and may be plastic coated. Positioned adjacent this outer water repellant layer 27 is a relatively water proof breathable layer 29 formed of currently available poromeric materials, permitting the passage of air without permitting the passage of water such as GORE-TEX Polytetrafluoroethylene. A heat insulating layer 31 is positioned adjacent waterproof breathable layer 29. This heat insulating layer 31 may be formed of a variety of materials. A lofting material or one which tends to expand in thickness so as to create air pockets between the top and bottom surfaces thereof, such as down, or synthetic or natural fibrous materials may be satisfactorily employed. THINSULATE which is a mixture of olefin and polyester fibers is found eminently suitable in providing desired heat insulation while at the same time being relatively resistant to moisture absorption. Secured to the inwardly facing surface of the heat insulating layer 31 is a slide layer 33. It is preferred that the slide layer be bonded to the inner face of the insulating layer 31 serving the two fold function of maintaining structural integrity of the insulating layer, and providing a slide surface to permit easy passage of a hand or liner into the shell 15. This slide layer is preferrably formed of an unbrushed or unsueded knit nylon. As is apparent to those skilled in the art, a variety of other materials having desired slide characteristics may be employed, such as textile lining fabric woven or knit of synthetic, natural or blends of these fibers.

In assembly, the heat insulating ply 31, and the slide layer 33 where formed of THINSULATE and nylon as above described are provided as a unitary construction which is cut to the desired mitt contour. The preformed GORE-TEX poromeric waterproof breathable layer 29 is provided and the relatively water repellant outer layer 27 is cut to desired contour, and layers 27, 29, 31 and 33 are then sewn or otherwise assembled into the illustrated mitt configuration utilizing conventional glove forming techniques.

Liner 40, as seen at the bottom of FIG. 2 is formed of a relatively porous moisture absorbing layer 45. This serves to provide desired warmth to the hands of the wearer to promote desired comfort. A variety of materials can be employed in forming layer 45 depending on the degree of heat insulation desired. A pile of flannel fabric formed of woven or knit synthetic, natural, or blend of the fibers may be satisfactorially employed. A polypropylene pile has been found quite satisfactory. Additionally, QUALLOFIL fibers backed for structural support have been found satisfactory, as has a knitted cashmere. A coarse outer surface layer 46 is preferraby formed on the porous moisture absorbent layer. A smooth inner surface layer 48 is provided preferrably of a knit relatively soft textile fabric made up of natural or synthetic fibers or a blend thereof. A pile polypropylene blend with the pile facing the interior of the glove has been found eminently suitable. The liner 40 as shown in FIGS. 1 and 2 of the illustrated embodiment is preferrably provided with a knit wristlet 41 extending beyond the cuff 49 of the liner 40.

Arranged to surround the exterior of the cuff of liner 40 preferrably at the hem, as best seen at the bottom of FIG. 2 is a fastening element 61 of a type which will be suitably interengaged with a mating fastening element 62 formed on the interior of cuff 20 also at the hem of the shell 15. Preferred interengaging fastening elements are formed by mating strips of VELCRO, the hook elements shown on strip 61, and the eye elements shown on 62. By positioning the interengaging strips 61 and 62 only along the cuffs, with interengagement taking place only when the cuffs are aligned it is seen that the liner may freely slip into the shell without interference by the strip at 62.

Liner 40 is fabricated employing conventional glove making techniques, cutting the component parts to a desired shape and sewing or otherwise fastening them together, and thereafter securing the knit wristlet 48 thereto.

Figure 4:
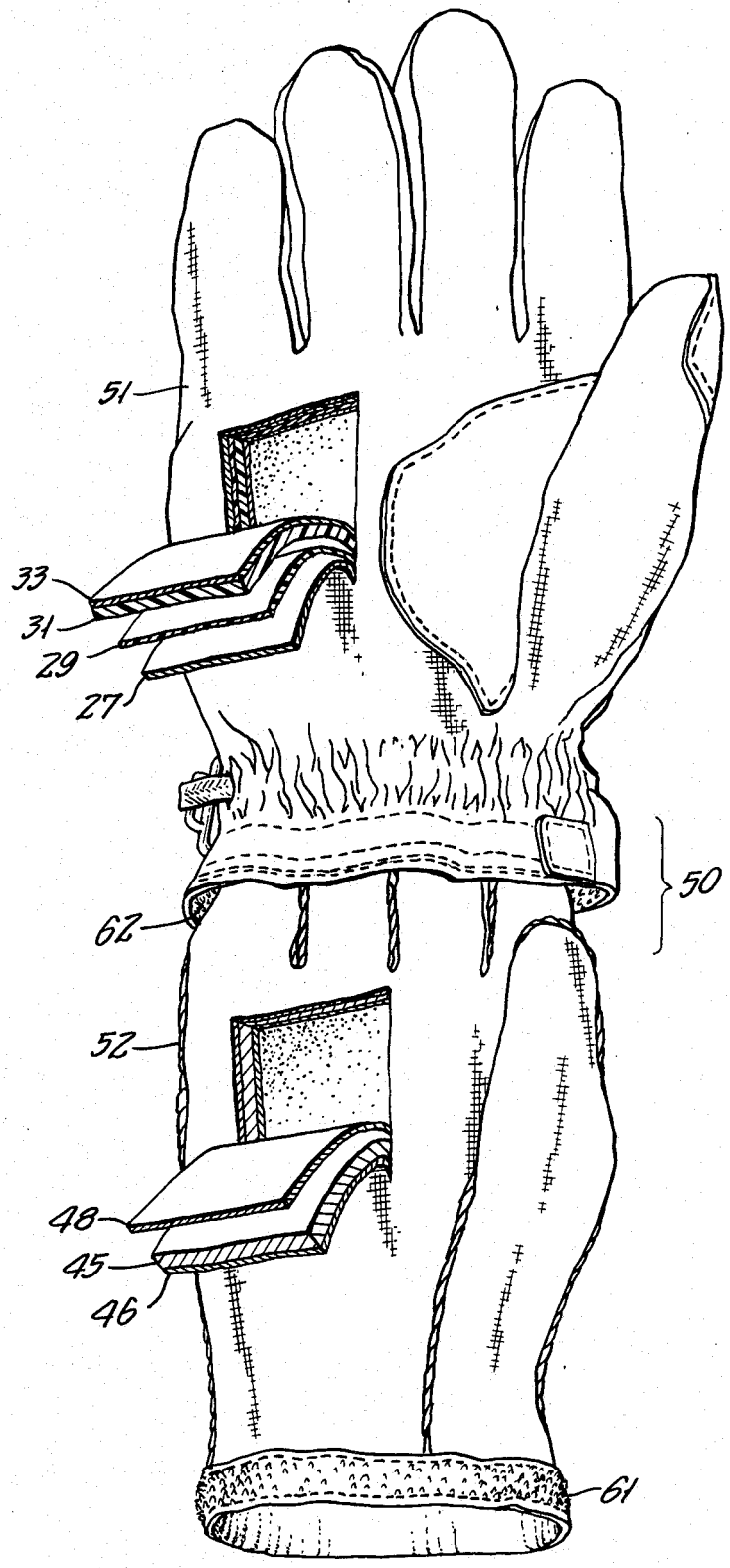
FIG. 4 is an exploded perspective view of a glove construction showing a liner and shell with a flap cut and fold out to illustrate the layers of the shell and liner of the glove.

The invention is shown embodied in connection with a glove 50 in FIG. 4 where the layers forming the plies of the glove shell 51 & liner 52 are as described in connection with the mitt. The only difference resides in the shaping of the glove with finger stalls in the shell and liner in conventional fashion. The plies of the glove shell are identified by numerals corresponding to those employed to identify the plies on the mitt shell, as are the liner plies illustrated. It will be understood by those skilled in the art, that fabrication of the glove is like the above described fabrication of the mitt employing conventional glove making techniques.

OPERATION

A glove or mitt 10 is fabricated as above described.

In use, the glove or mitt may be marketed with different kinds of liners, or different kinds of liners may be made available to purchasers who wish to change the insulating and/or moisture removing qualities of the glove or mitt.

Further, it will be recognized that the shell of the glove or mitt may be worn without a liner if desired providing a waterproof, heat insulating hand enclosure. The user may then freely insert his hand into the glove or mitt, and facility of insertion is enchanced by virtue of slide layer 33 formed on the interior of the shell.

A liner suitable for cold weather wear is suitably fabricated with an absorbent layer 45 of a pile material such as flannel, made of synthetic or natural fibers or a blend thereof, a polypropylene blend being found eminently suitable, with the pile facing against the hand. Insertion of the hand into the liner is comfortable against the relatively soft pile of the flannel, and insertion of the liner into the shell is facilitated by virtue of the slide surface on the shell. The coarse or sueded nylon outer surface on the liner minimizes liner slippage with respect to the shell by virtue of the frictional interengagement between the interior of the shell and the exterior of the liner.

As an alternative, a lofted material such as FIBERFILL faced on the interior with a polypropylene fleece knitted fabric, and on the outside with sueded nylon is found eminently satisfactory. In other situations, a knitted cashmere, or blend of cashmere and other fibers, formed with a sueded nylon exterior is found satisfactory.

Assembly of the liner with the shell is most easily accomplished by having the user don the liner, and inserting the liner clad hand into the shell. When the liner and shell of the glove or mitt are arranged in operative position, the application of pressure about the wrist adjacent the cuff serves to interlock the VELCRO stips maintaining the liner in operative position.

Removal of the liner for replacement, and/or washing or cleaning is accomplished by separating the VELCRO or other closure and removing the liner from the shell.

The above disclosure has been given by way of illustration and elucidation, and not by way of limitation, and it is desired to protect all embodiments of the herein disclosed inventive concept within the scope of the appended claims.

What is claimed is:

1. A glove or mitt construction comprising:
a multi-ply outer shell, said shell comprising:
an outer water repellant layer;
an inner heat insulating layer;
a relatively waterproof layer between said outer water repellant layer and said inner heat insulating layer;
a slide layer formed on the inner surface of said heat insulating layer;
a selectively removable liner formed of a layer of relatively absorbent material removably positioned in said shell; and
interengaging means between said removable liner and said outer shell.

2. A glove or mitt as in claim 1 in which said shell and said liner each comprise a cuff portion, and said interengaging means are positioned between said cuff portions.

3. A glove or mitt as in claim 2 in which said strips are at the hem of the cuff of the liner and shell.

4. A glove or mitt as in claim 1 in which said liner comprises a woven or knit fabric of natural, synthetic, or a blend of such fibers.

5. A glove or mitt as in claim 4 in which said liner comprises a piled fabric.

6. A glove or mitt as in claim 5 in which said interengaging means comprise selectively interengageable hook and eye strips.

7. A glove or mitt construction as in claim 1 in which said selectively removable liner comprises:
a relatively coarse outer surface layer on said absorbent liner;
a relatively smooth inner surface layer on said absorbent layer.

8. A glove or mitt as in claim 7 in which said relatively smooth inner liner surface layer comprises a layer having at least one surface of unbrushed synthetic material facing the interior of said liner.

9. A glove or mitt as in claim 7 in which said relatively coarse outer liner surface layer comprises a brushed synthetic material having at least one brushed surface facing out from said liner.

10. A glove or mitt construction as in claim 1 in which said outer water repellant layer is a closely woven textile fabric of synthetic, natural or a blend of natural and synthetic fibers.

11. A glove or mitt construction as in claim 10 in which said outer shell is plastic coated.

12. A glove or mitt construction as in claim 10 in which said outer shell is formed of sheet plastic.

13. A glove or mitt construction as in claim 1 in which said heat insulating layer comprises a fabric formed of lofted fibers.

14. A glove or mitt construction as in claim 13 in which said heat insulating layer comprises a fabric formed of synthetic fibers.

15. A glove or mitt construction as in claim 13 in which said heat insulating layer comprises of a mixture of olefin and polyester fibers.

16. A glove or mitt construction as in claim 1 in which said relatively waterproof layer is breathable and comprises polytetrafluoroethylene fibers.

17. A glove or mitt construction as in claim 16 in which said breathable layer is formed of a poromeric material.

18. A glove or mitt construction as in claim 1 in which said outer water repellant layer is leather.

19. A glove or mitt as in claim 1 in which said slide layer comprises a material formed of synthetic fibers.

20. A glove or mitt as in claim 1 in which said slide layer comprises a fabric having at least one surface of unbrushed woven nylon which is positioned to face the interior of said shell.

* * * * *